United States Patent [19]

Brace et al.

[11] 4,057,420

[45] Nov. 8, 1977

[54] METHODS FOR DISSOLVING VOLATILE ADDITION AGENTS IN MOLTEN METAL

[75] Inventors: Arthur A. Brace, Mountainside; Alexander Lesnewich, New Providence, both of N.J.

[73] Assignee: Airco, Inc., Montvale, N.J.

[21] Appl. No.: 655,794

[22] Filed: Feb. 6, 1976

[51] Int. Cl.[2] ..... C21C 7/00

[52] U.S. Cl. ..... 75/53; 75/129; 75/130 R

[58] Field of Search ..... 75/53, 58, 129, 130

[56] References Cited

U.S. PATENT DOCUMENTS

| | | | |
|---|---|---|---|
| 3,728,109 | 4/1973 | Okubo | 75/129 |
| 3,729,309 | 4/1973 | Kawawa | 75/129 |

*Primary Examiner*—P. D. Rosenberg
*Attorney, Agent, or Firm*—David L. Rae; Larry R. Cassett; Edmund W. Bopp

[57] ABSTRACT

Methods and apparatus for introducing addition agents into molten metal retained in a vessel include providing a wire comprised of a metallic sheath encapsulating powdered and/or solid addition agents, preheating the wire with a controlled electrical current while feeding the preheated wire into the molten metal such that the metal sheath and addition agents melt before the wire contacts a vessel wall and the addition agents homogeneously dissolve at a predetermined rate in the molten metal. Also, the addition agents may be selected so as to react with impurities such as oxygen, sulfur, etc. to enable the removal thereof from the molten metal.

5 Claims, 3 Drawing Figures

METHODS FOR DISSOLVING VOLATILE ADDITION AGENTS IN MOLTEN METAL

BACKGROUND OF THE INVENTION

The present invention relates to improved methods and apparatus for treating molten metal and more particularly to methods and apparatus for efficiently introducing reactive, volatile addition agents into such metal at increased rates.

In order to obtain desired metallurgical characteristics of a particular metallic product, it is frequently necessary to dissolve appropriate addition agents in the molten metal. However, many times such addition agents are highly volatile or reactive and thus, cannot readily be exposed to atmospheric oxygen prior to dissolution in the particular molten metal under treatment. Furthermore, many of such addition agents are of relatively low density and will tend to float on the surface of a molten metal such as iron rather than disperse substantially homogeneously therein. Thus, the mere charging of a quantity of such addition agents in either a lump or powdered form into a molten metal such as iron, presents extreme hazards to operating personnel due to the high reactivity of such agents and has also been unsatisfactory in providing a homogeneous dispersion and 'recovery' of such addition agents in the molten metal. In addition, prior art techniques have been limited with respect to the quantities of agents that can be added to molten metal.

In order to avoid substantial losses of relatively expensive, addition agents, such as by reaction with atmospheric oxygen, it has been proposed to protect such addition agents during introduction into a molten bath. One such technique for protecting volatile addition agents is to encapsulate such agents as powder and/or solid wire in a tubular sheath and subsequently feed the composite or cored wire into a bath of the molten metal under treatment. In general, this technique for treating a molten metal bath has proven relatively effective in allowing the desired metallurgical characteristics of the bath under treatment to be obtained. However, in applications wherein the molten metal is flowing through a tundish or the like at a relatively rapid rate, on the order of 5–10 tons per min. in many steel mills, for example, one or more cored wires must be fed at extremely rapid rates in order to assure that sufficient quantities of addition agents are in fact introduced into the molten metal such that desired metallurgical characteristics can be realized. Under such circumstances, it has been found that merely increasing the wire feed speed in order to add sufficient quantities of addition agents results in a further serious problem, namely the fact that the wire is not fully melted by the molten metal before the wire contacts the bottom or other wall of the tundish or the like. This latter action causes the wire to bend, curl and re-emerge unmelted at the surface of the molten metal without providing the desired alloying effect. Similarly, in applications wherein a cored wire is supplied to a molten metal retained in an ingot mold or ladle, i.e., a stationary body of molten metal, it is none the less desired to augment as far as possible the rate of introducing such addition agents into the molten metal. It will be appreciated that the longer the molten metal is permitted to stand, temperature losses increase accordingly and reactive addition agents will "fade" or lose effectiveness, for example from oxidation beneath the melt surface. However, merely increasing the wire feed speed will result in problems similar to those previously described in connection with introducing addition agents into molten material flowing through a tundish.

Thus, present metallurgical techniques for treating molten metal with reactive and/or low density addition agents reflect a clear need for a process wherein such agents can be rapidly, and in a controlled manner without substantial loss, dissolved in a bath of molten metal.

OBJECTS OF THE INVENTION

It is an object of the present invention to provide improved methods and apparatus for efficiently introducing highly reactive addition agents into molten metal.

It is a further object of the present invention to provide improved methods and apparatus for treating molten metal at increased rates with powdered and/or solid addition agents encapsulated in a metallic sheath.

It is another object of the present invention to provide improved methods and apparatus for introducing low density and/or reactive addition agents into molten metal wherein relatively thick walled, and consequently less expensive, sheaths can be utilized for transferring such agents to the molten metal and yet enable adequate or predetermined dissolution or reaction rates to be obtained.

It is still another object of the present invention to provide improved methods and apparatus for treating molten metal with relatively low density, reactive addition agents wherein reaction of such agents with molten metal impurities occurs before such agents float to the molten metal surface.

It is yet a further object of the present invention to provide improved methods and apparatus for alloying molten metal with reactive addition agents wherein the losses of such agents are minimized.

It is a further object of the present invention to provide improved methods and apparatus for alloying molten metal with addition agents wherein extreme concentration gradients of addition agents dissolved in the molten metal are substantially avoided.

Other objects of the present invention will become apparent from the detailed description of an exemplary embodiment thereof which follows and the novel features of the present invention will be particularly pointed out in conjunction with the claims appended hereto.

SUMMARY

In accordance with the present invention, a method of introducing addition agents into molten metal in a containing vessel comprises the steps of providing a wire comprised of said agents encapsulated in powder and/or solid form in a metallic sheath, resistively preheating said wire with a controlled electrical current while feeding said wire into the molten metal with said preheating being controlled to cause the sheath and agents to melt in the molten metal such that contact between said wire and a vessel wall is precluded and said agents are dissolved substantially homogeneously in said molten metal and/or react with impurities therein. The particular addition agent introduced into the molten metal is generally highly volatile or reactive in ambient atmosphere and may, for example, comprise titanium, magnesium, calcium, rare earth metals, rare earth metal silicides or mischmetal or the like, while boron, zirconium, etc. may be added for alloying purposes. Other suitable addition agents or alloying elements may be utilized as well. The metallic sheath of the wire encapsulating such addition agents in powder and/or solid form preferably comprises steel although aluminum or stainless steel, or even copper alloys may be suitable depending upon the particular molten metal under treatment. In addition, although a "cigarette" configuration or shape of the sheath is preferred, a sheath having other cross sections may be utilized. In order to improve the rate of heat transfer from the metallic sheath to the powdered addition agent, the sheath may be formed with one or more internal folds. However, the particular sheath configuration utilized will also depend upon the necessary solution rate, namely the rate at which addition agents will react with impurities of, or dissolve in, the molten metal as it would obviously be undesirable to select a sheath configuration which would degrade or hinder such a solution rate.

In accordance with the present invention, the diameter of the wire utilized for introducing molten metal with low density of reactive addition agents into molten metal may be of any suitable dimension and one or more of such wires may be resistively preheated and concurrently supplied to the molten metal under treatment at a controlled rate. In addition, the wall thickness of the metallic sheath may be selected such that upon preheating, the sheath and encapsulated agents will melt at a desired, rapid rate and at a predetermined depth in the molten metal. It is understood that by providing the thickest walled sheath which will also melt at a desired rate, the wire can be drawn on conventional equipment rather than produced by roll forming and can be fed more easily as it can be pushed with greater loads. In addition, thicker sheathed wire will withstand greater feed roll pressures and will exhibit a greater resistance to opening and spillage of the encapsulated contents. Furthermore, greater reductions per drawing pass can be made thereby decreasing the number of required drawing operations.

Preheating of the wire containing low density or reactive addition agents to be introduced into molten metal may be accomplished by either resistance heating, induction heating, high frequency heating, or the like wherein a controlled electrical current is utilized in effecting a desired degree of heating of the wire. In addition, it is also possible, in accordance with the present invention, to utilize burners or the like for heating such wire prior to passing the same into the bath of molten metal.

BRIEF DESCRIPTION OF THE DRAWING

The invention will be more clearly understood by reference to the following description of an exemplary embodiment thereof in conjunction with the following drawing in which.

DESCRIPTION OF PREFERRED EMBODIMENT

Figure 1:
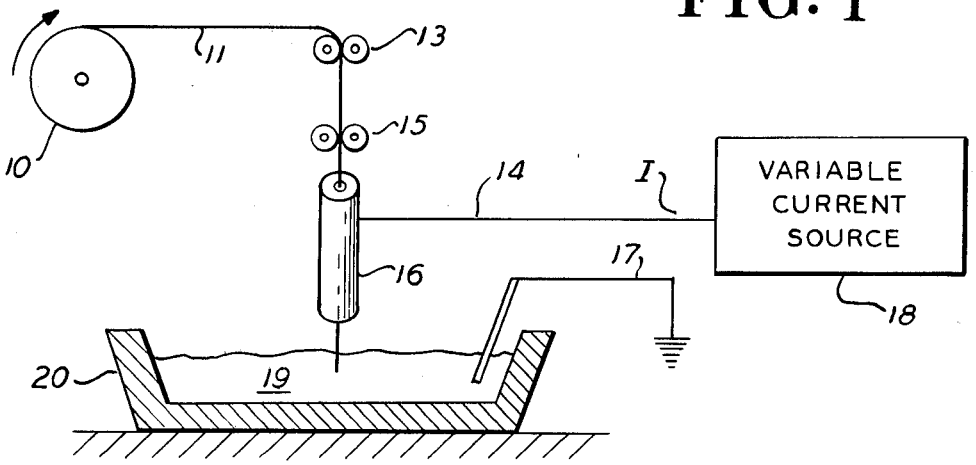
FIG. 1 is a schematic view of apparatus for feeding a wire encapsulating addition agents into a molten material.

Referring now to FIG. 1, illustrated therein is an exemplary embodiment of apparatus for introducing addition agents into molten metal 19. A supply 10, such as a spool or roll of wire 11 is provided together with a pair of idler rollers 13 and drive or feed rollers 15. Preferably, wire 11 includes a metallic sheath which may be comprised of a material such as iron, aluminum or the like with powdered addition agents such as calcium, titanium, rare earth metals, rare earth silicides or mischmetal formed therein as a core. In addition, the overall dimensions of wire 11, i.e. the wall thickness thereof, is sufficiently large such that expensive and complex forming techniques are unnecessary for preparing wire 11. For example, wire 11 may be formed from strip material with powder deposited thereon as the strip is subjected to a plurality of roll forming operations. Alternately, the composite wire 11 may also be formed by conventional extrusion techniques. Although it is preferred to form wire 11 in a "cigarette" or annular shape, other cross-sections may be utilized and the metallic sheath may be formed with internal folds to improve heat transfer to the powdered or solid addition agents during preheating. However, it is important to assure that by providing such folds or the like (not shown), the rate at which addition agents dissolve in the molten metal is not impaired. Idler rollers 13 and feed rollers 15 constitute devices well known to those skilled in the art for feeding a wire. Preferably, variable drive means (not shown) are provided for operating feed rollers 15 such that wire 11 may be fed into a molten metal 19 at a predetermined rate. A contact tube 16 which may be comprised of any suitable conductive material is provided for receiving wire 11 and enabling passage thereof into molten metal 19. A current source 18 which may comprise any conventional electrical or electronic circuitry for producing a controlled electrical current I is connected by conductor 14 to contact tube 16 such that wire 11 is resistively preheated as it passes from tube 16 into molten metal 19. Further spaced feed or idler rollers (not shown) may be utilized for supplying a current through a length of wire 11 between roller sets thereby resistively preheating such wire. Preferably, vessel 20 is provided with a refractory lining and may take the form of a conventional tundish, ladle or ingot mold adapted to retain a body of molten metal 19. Conductor 17 is disposed in contact with molten metal 19 directly in order to complete an electrical circuit to ground as shown in FIG. 1 although a second preheated wire (not shown) could serve as a ground connection.

The operation of the exemplary embodiment of apparatus illustrated in FIG. 1 will now be described. Initially, upon introducing a desired quantity or batch of molten metal 19 into vessel 20, current source 18 is energized to supply an electrical current through conductor 14 to contact tube 16. Concurrently therewith, feed rolls 15 are actuated and are effective to draw wire 11 from supply 10 such that the wire between tube 16 and molten metal 19 is resistively preheated by the passage of current therethrough. Preferably, wire 11 is heated to a controlled temperature so that heating of the metallic sheath (which carries the electrical current) effects a heating of the volatile addition agents encapsulated therein. Thus, as wire 11 enters molten metal 19 in a preheated state, wire 11 and the low density or reactive addition agents therein are melted at a predetermined depth in metal 19 such that the addition agents may be effectively dissolved, or react with impurities in molten metal 19. As a consequence of such preheating, wire 11 may be supplied at a high but required rate to molten metal 19 without the wire contacting either a bottom or sidewall of vessel 20. In applications wherein a relatively low density agent such as calcium is to be introduced into molten steel, it is preferred steel cause the wire to melt at a depth well below the molten metal surface. This has the effect of providing more time for the calcium (either in powder or in solid form) released into the molten metal 19 to react therewith. As calcium boils at 1480° C, it is preferred to introduce this agent into molten steeel (1535° C) such that the wire sheath melts at a relatively deep position in the vessel. This results in the melting and vaporization of calcium at a point or depth such that as the calcium vapor rises through the molten metal, a sufficient residence time elapses to enable calcium to react with impurities ($O_2$, $S_2$, etc.) in the molten steel. In this manner, a greater portion of the supplied calcium is "recovered" by the molten metal and less calcium is lost as vapor to the ambient atmosphere. Thus, by controlling the preheating of the cored wire, the depth at which the wire melts in the molten metal and hence the residence time of such agents in the molten metal may be controlled to effect the desired reactions. Furthermore, the bubbling of vaporized addition agents will generate a slight mixing action or turbulence which will serve to promote such reactions as previously described.

In certain applications, vessel 20 may comprise a tundish wherein a relatively high flow of molten metal is passed therethrough. In commercial mills, as much as 5–10 tons of molten metal per minute may flow through a typical tundish. Therefore, in order to introduce even several pounds of volatile addition agents into said flowing molten metal per minute, a relatively high feed rate of wire 11 into molten metal 19 is required. In accordance with the present invention, by preheating wire 11 and thus causing this wire to melt at a desired rate and hence at a predetermined depth after entering molten metal 19, wire 11 is simply precluded from striking a wall or bottom of vessel 20. Thus, the method and apparatus according to the present invention enable the homogeneous introduction of adequate quantities of low density or reactive addition agents into a body of molten metal flowing at a relatively high rate, i.e. several tons per minute, and hence, the metallurgical characteristics desired from such a process can in fact be obtained.

It will be appreciated that although contact tube 16 has been described in the exemplary embodiment of apparatus illustrated in FIG. 1 as a device for effecting the resistive preheating of wire 11, other suitable preheating means such as induction heaters, high frequency heating devices, etc. may also be utilized in place of or in addition to contact tube 16. It is important, however, that regardless of the particular preheating device utilized, the supply of selected current thereto will enable accurate control over the degree to which wire 11 is preheated and consequently, the depth in molten metal at which wire 11 will be melted. Thus, the melting of wire 11 at an acceptable rate in molten metal 19 is assured and the desired alloying of molten metal is also obtained.

Figure 2:
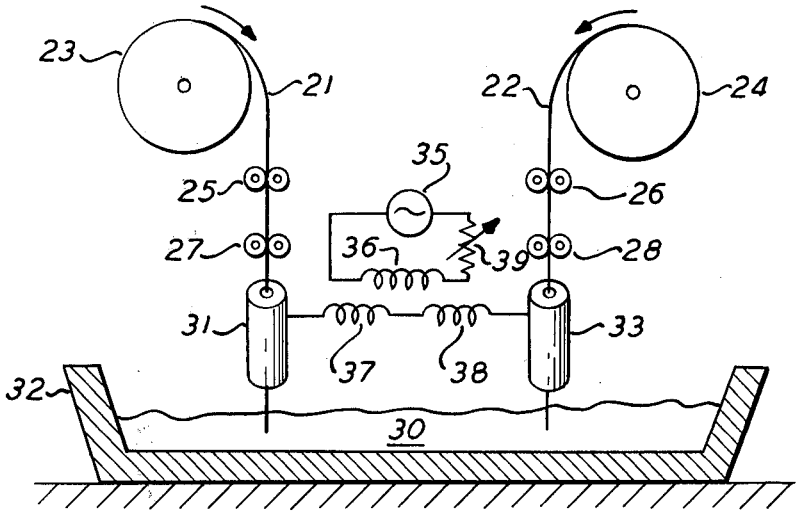
FIG. 2 is an exemplary embodiment of apparatus in accordance with the present invention for supplying a plurality of wires encapsulating volatile addition agents into the molten metal.

Referring now to FIG. 2, illustrated therein is an exemplary embodiment of apparatus in accordance with the present invention for supplying a pair of preheated wires 21 and 22 to a molten metal 30. Preferably, a pair of reels or spools 23 and 24 are provided for retaining a supply of wires 21 and 22, respectively. In addition, idler rollers 25 and 26 and feed rollers 27 and 28 are appropriately arranged for passing wires 21 and 22 respectively through contact tubes 31 and 33. In this manner, each of wires 21 and 22 may be introduced into a body of molten metal 30 retained within vessel 32. An electrical power supply 35, which may comprise a conventional a.c. power source, is preferably connected through a variable resistor 39 to a primary transformer winding 36 which in turn is coupled to secondary windings 37 and 38. Alternately, a relatively low voltage three-phase a.c. power supply and transformer may be utilized to supply the necessary current for resistively preheating three wires. Returning to FIG. 2, each of windings 37 and 38 is connected to contact tubes 31 and 33, respectively. Although the latter contact tubes are illustrated as devices for preheating wires 21 and 22, respectively, it will be understood that any of the previously described preheating systems may be utilized as well. In addition, vessel 32 may, for example, comprise a tundish through which molten metal, such as molten iron, may flow at a rate of approximately 5–10 tons per minute or, vessel 32 may comprise a conventional ladle or ingot mold as previously described.

In operation, each of wires 21 and 22 is driven by means of respective feed rollers 27 and 28 in a manner similar to that as previously described in connection with the translation of wire 11 by apparatus illustrated in FIG. 1. Accordingly, each of wires 21 and 22 is passed through respective contact tubes 31 and 33 and as a consequence of setting resistor 39 to a particular value, a predetermined electrical potential is induced by primary winding 36 into secondary windings 37 and 38, and a suitable voltage is supplied to contact tubes 31 and 33 wherein the controlled resistance heating of corresponding wires 21 and 22 will occur. In this manner, each of such wires is preheated to a desired temperature before passing into molten metal 30 wherein the melting of such wires is controlled and contact between wires 21 or 22 and a wall or bottom vessel 31 is essentially precluded. In this manner, volatile addition agents encapsulated within wires 21 and 22 are heated prior to passing into molten metal 30 and upon entering such molten metal the wires are melted at a predetermined depth.

Figure 3:
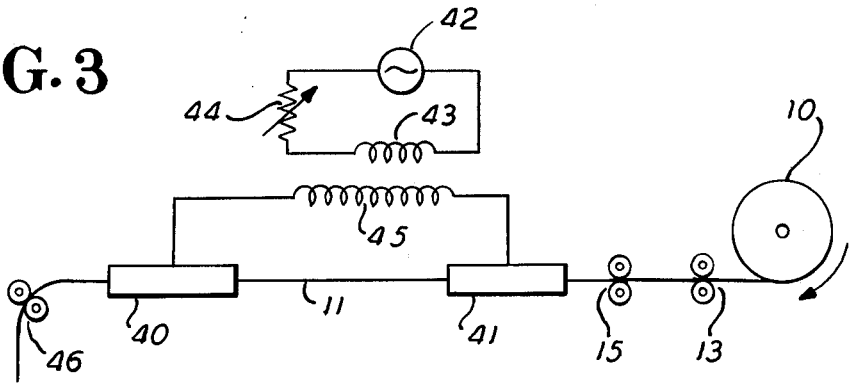
FIG. 3 is a further exemplary embodiment of apparatus for preheating a wire prior to passage thereof into a molten metal.

In addition to the aforedescribed apparatus a wire 11 containing low density, reactive addition agents may be supplied from a roll 10 as illustrated in FIG. 3. Idler and feed rollers, 13 and 15, respectively, are effective to pass wire 11 through contact tubes 40 and 41 and a further set of rollers 46 is provided to guide preheated wire 11 into a molten metal bath (not shown). A variable current source, which may comprise an a.c. voltage supply 42, potentiometer 44 and primary and secondary windings 43 and 45, is effective to supply a current to contact tubes 40 and 41. As this current is passed through the portion of wire 11 between tubes 40 and 41 at any particular instant of time, wire 11 is continuously, resistively preheated in a controlled manner before wire 11 is introduced into the molten metal. It will be understood that rollers or other suitable electrical contact devices may be utilized in lieu of contact tubes 40 and 41. Preferably, a relatively low voltage supply 42 is utilized to preclude arcing. In addition, the benefits accruing from preheating wire 11 as previously set forth are also realizable from operation of the apparatus illustrated in FIG. 3.

EXAMPLE

In order to demonstrate the effectivenss of the method and apparatus according to the present invention, a 75 lb. charge of steel product was melted in the crucible of an induction furnace. The crucible of this furnace exhibited a total depth of approximately 12 inches and a diameter of approximately 9 inches. A portion of the molten steel in the crucible was removed to obtain a pool of molten metal approximately 6 inches deep at a temperature of 2850° F. In order to feed a wire 0.093 inch in diameter and having a metallic sheath encasing powdered rate earth metal silicides, an "Aircomatic" wire feeding system, commercially available from the assignee of the present invention was utilized. The foregoing wire was fed through the hand held "gun" of this feeding system at the rate of 550 in./min. An operator wearing appropriate protective clothing held the gun of the aforementioned wire feeding system approximately 3.0 inches from the surface of the molten metal in the crucible and supplied such wire, without preheating, at the rate of 550 in./min. into the molten metal. Within seconds after initiating the aforementioned wire feed, the operator was able to feel the wire striking the crucible bottom and curling up, still unmelted, in the crucible. At this point the wire was removed and was observed to extend from the feeding gun by approximately 9.0 inches. Although contorted, the removed wire had not melted in the crucible and accordingly, the rare earth metal silicides encapsulated in the removed wire were not transferred to the molten metal.

The removed wire was then cut off and a graphite ground electrode was inserted into the molten metal. The power supply of a conventional electric welding machine was energized and a voltage of 18 v. and a current of 800 amps. were supplied to the tip of the welding gun. This tip acted as a contact tube and passed the foregoing current into the wire being fed thereby resistively preheating the wire before the wire was passed into the molten metal. The wire feed speed was maintained at 550 in./min. The operator was unable to detect any contact between the wire and the crucible bottom and upon removing the wire, it was observed that only approximately 1.0 inch of wire extended into the molten metal before the wire melted.

While the present invention has been particularly described in terms of specific embodiments thereof, it will be understood that numerous variations upon the invention are now enabled to those skilled in the art, which variations are again within the instant teachings. Accordingly, the present invention is to be broadly construed and limited only by the scope and spirit of the claims now appended hereto.

What is claimed is:

1. A method for reacting impurities in molten steel in a vessel exposed to the atmosphere with an addition agent having a boiling point below the melting point of steel comprising the steps of providing a wire having a metallic sheath encapsulating said agent in powder form therein; passing an electric current through at least a portion of said wire thereby resistively preheating said wire; feeding the preheated wire, while said current is passed therethrough, into said molten steel such that said metallic sheath is melted and said addition agent is sublimed before the wire can contact a vessel wall; and controlling the value of said electric current such that said resistive preheating and heating of said wire by conduction of heat from said molten steel are effective to melt said sheath and sublime said addition agent at a predetermined depth in said molten steel such that said sublimed addition agent reacts with said impurities before said agent rises by buoyancy to the surface and escapes from said molten steel.

2. The method as defined in claim 1 wherein said addition agent is calcium powder.

3. A method of introducing addition agents into molten steel in a vessel having bottom and side walls with said molten steel having a surface exposed to ambient atmosphere comprising the steps of providing a wire including a metal sheath encapsulating one or more addition agents selected from the class of calcium, titanium, boron, zirconium, rare earth metals, rare earth metal silicides and mischmetal; feeding said wire into said molten steel at a predetermined rate; passing an electrical current through at least a portion of said wire to resistively preheat said wire as said wire is fed into said molten steel; and controlling the magnitude of said electrical current such that said wire is melted in said molten steel before said wire contacts said bottom or side walls of said vessel whereby said addition agents are substantially homogeneously dissolved in said molten steel.

4. A method as defined in claim 3 wherein the step of feeding said wire comprises passing said wire through a contact tube and wherein the step of passing said electrical current comprises supplying said current to said contact tube such that said wire is resistively preheated by said current.

5. A method as defined in claim 3 wherein said vessel comprises a tundish and additionally comprising the step of flowing said molten steel through said tundish at a rate of between approximately 5–10 tons/minute.

* * * * *